US007465235B2

(12) United States Patent
Evans

(10) Patent No.: US 7,465,235 B2
(45) Date of Patent: Dec. 16, 2008

(54) COMBINED HUMAN CATAPULT AND SAFETY LANDING APPARATUS

(76) Inventor: Robert Bruce Evans, 1261 W. Hummingbird St., West Valley City, UT (US) 84123

( * ) Notice: Subject to any disclaimer, the term of this patent is extended or adjusted under 35 U.S.C. 154(b) by 374 days.

(21) Appl. No.: 11/415,468

(22) Filed: May 2, 2006

(65) Prior Publication Data

US 2007/0259726 A1 Nov. 8, 2007

(51) Int. Cl.
*A63G 31/04* (2006.01)
*A63G 31/00* (2006.01)

(52) U.S. Cl. ..... 472/50; 472/133; 472/134

(58) Field of Classification Search ..... None
See application file for complete search history.

(56) References Cited

U.S. PATENT DOCUMENTS 1,998,508 A * 4/1935 Kappenberg ..... 248/629
2,282,315 A 5/1942 Adams
3,466,053 A 9/1969 Whaley
4,583,743 A * 4/1986 Macek ..... 273/368
4,737,107 A * 4/1988 Bories et al. ..... 434/29
5,064,191 A * 11/1991 Johnson ..... 482/143
5,123,643 A * 6/1992 Heilhecker et al. ..... 124/21
5,303,695 A 4/1994 Shopsowitz
5,769,724 A 6/1998 Wiegel
6,210,285 B1 * 4/2001 Susko ..... 472/50
7,182,695 B1 * 2/2007 Tostenson et al. ..... 472/50

* cited by examiner

*Primary Examiner*—Kien T Nguyen

(57) ABSTRACT

A combined human catapult and safety landing apparatus which is a pneumatically controlled human catapult for launching a person in a repeatable flight path in conjunction with a cooperating safety landing apparatus that eliminates the need for less safe water, net or mat landings. An air cylinder that is supplied with a predetermined quantity of gas based upon the passenger's weight is the controllable energy means for launching a passenger a predetermined distance. Having the throw distance controllable allows a safe, repeatable landing within the parameters of the safety landing apparatus. Within the landing apparatus area, the passenger is seated in the catapult that is positioned between an elongate pair of post elevated wires encircled by slidable rings. In flight, the rings which are tethered to the passenger, slide along the wires being pulled by the passenger which, at the same time, provides a controlled flight path and landing similar to sport skydiving but at much lower speeds and heights.

1 Claim, 3 Drawing Sheets

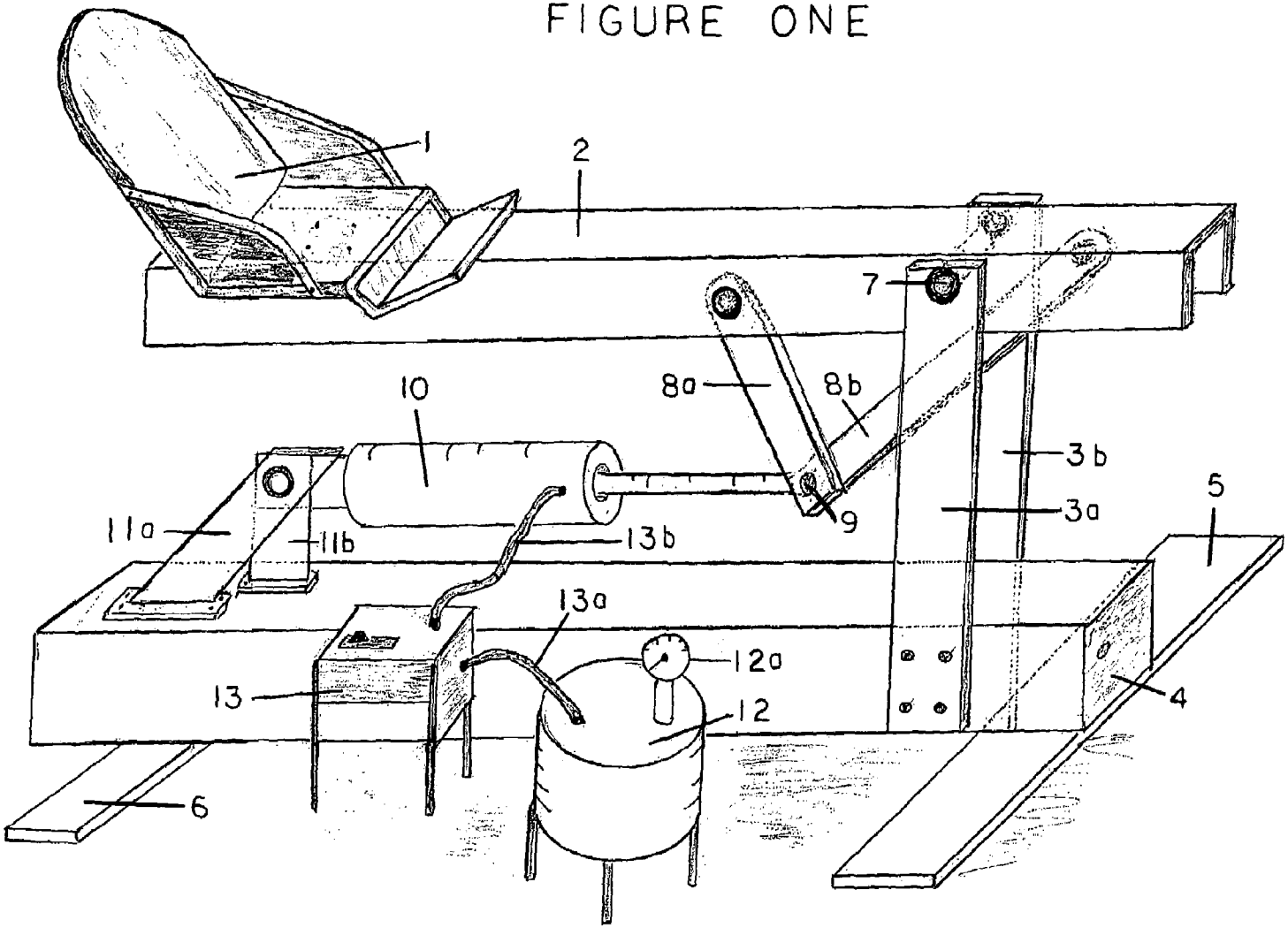
FIGURE ONE

FIGURE TWO
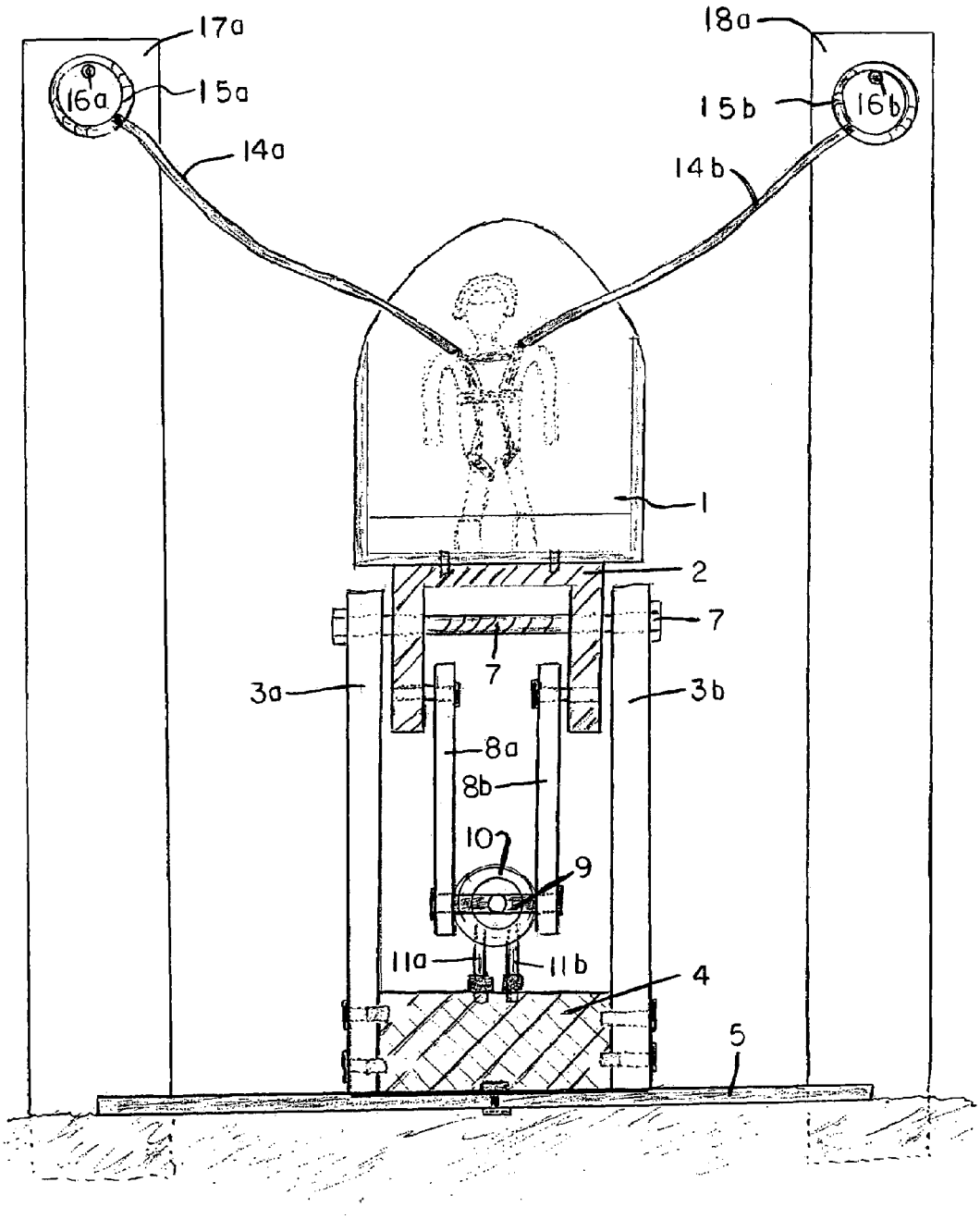

FIGURE THREE
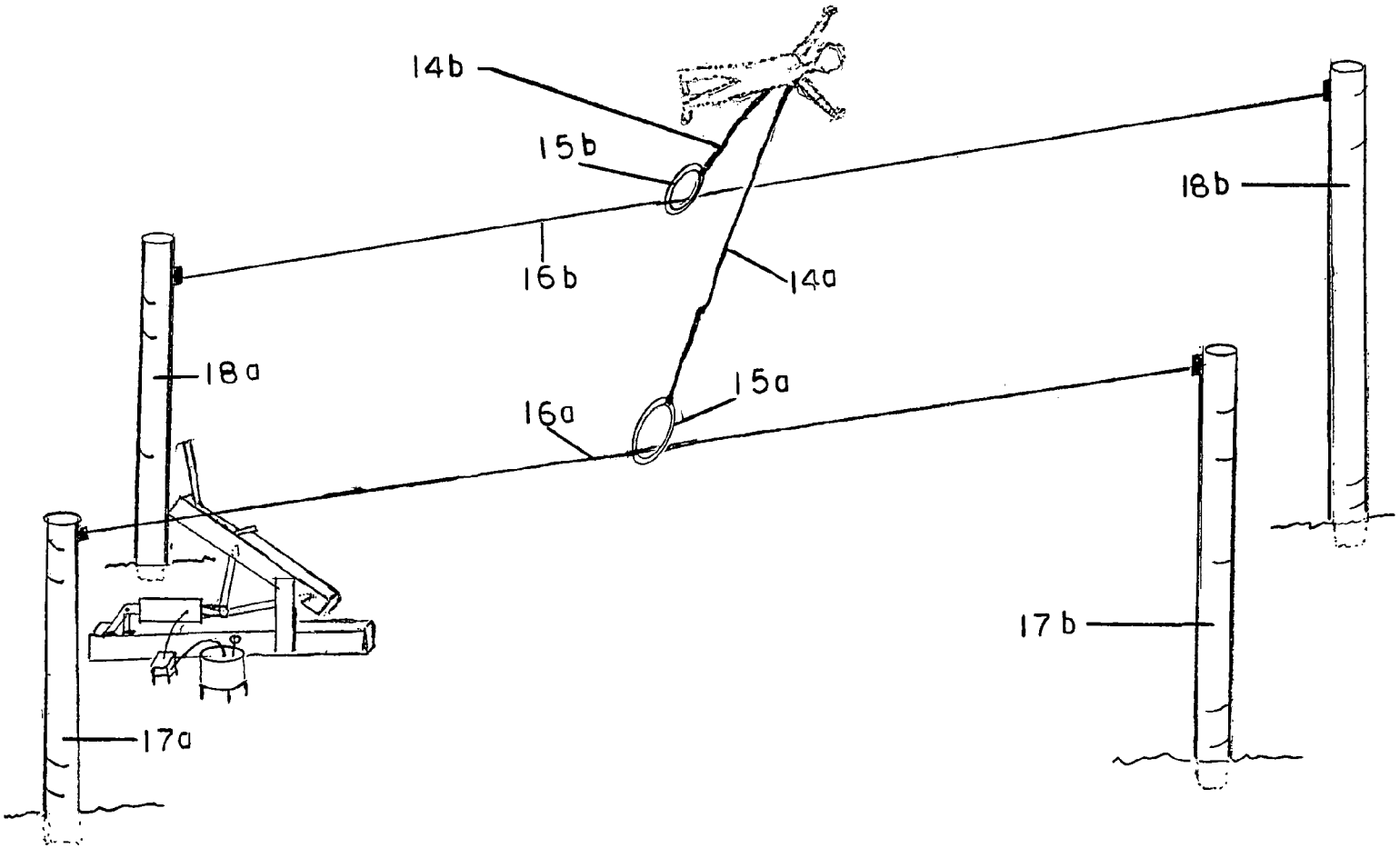

COMBINED HUMAN CATAPULT AND SAFETY LANDING APPARATUS

BACKGROUND OF THE INVENTION

1. Field of the Invention

The body of art applying to this invention includes pneumatically propelled catapults as an amusement device for human free flight over a land surface. As human landing safety is a necessary requirement in carrying out this and like inventions, the field of the invention also includes a cooperating flight and landing system to prevent serious injury or potential death. The flight landing apparatus, providing physical connection to the catapult by tethered human contact, may include wire, rope or filament means attached between and elevated by anchored, pedestals or pole means.

2. The Prior art

The main advantages of present invention are primarily concerned with causing and duplicating a precisely defined air born trajectory path for a human using volume controlled air pressure applied to a pneumatic cylinder combined with a tested, above ground, safety landing apparatus for human safety. The flight path of the human must stay within a controlled distance, which allows a safe landing within the defined parameters of the landing apparatus. Redundant elements are employed throughout the invention to maximize the safety of the user. Established safety materials used in parachuting and mountain climbing are likewise employed.

Some of the prior art related to this invention are not particularly interested in two of the major problems related to this art, namely safe human landing concerns and precise control of human flight. U.S. Pat. No. 2,282,315 by L. S. Adams and U.S. Pat. No. 3,466,053 by W. F. Whaley and U.S. Pat. No. 5,303,635 by Shopsowitz and finally U.S. Pat. No. 5,769,724 by Wiegel appear to have these two problems which the present invention overcomes. A land-based catapult, of the type being disclosed here, requires apparatus for safe human landings combined with precise flight control if for no other reason than simple human safety.

SUMMARY OF THE INVENTION

An amusement device which is a pneumatically controlled human catapult for throwing a person in a defined repeatable flight path including a cooperating safety landing apparatus which allows the safe enjoyment of acceleration, free falling, deceleration and landing above a land surface there by eliminating the need for water or mat landings. A passenger seat is positioned on a throwing arm which is forced upward from underneath by redundant thrust legs which are rotated by an air cylinder. In controlling the air pressure supplied to the air cylinder, passengers of various weights can enjoy the advantage of being thrown the same distance thereby allowing a safe landing within the defined boundaries of the safety landing apparatus. The cooperating landing apparatus provides two safety lines attached at their ends near the right and left side of the passengers' shoulders in a manner similar to sport parachuting equipment means. The other end of the each safety line is attached to a ring. Each ring encircles a wire providing respective slidable connection for each ring along each wire. Each wire is held elevated and taught by anchored, vertical posts stationed at both ends of each wire. Each wire and post arrangement is positioned lengthwise on the right and left side of the passengers predetermined flight path. The rings slide along the wires, being pulled by the passenger's safety lines, as the flight progresses from beginning to end. The two posts positioned near the catapult are of lesser height than the posts positioned near the end of the flight path disposing the slope of the wires to increase at a rate approximately equal to the maximum height achieved in the preset flight path affording the passenger flight above the wires. The physical distance between the wires and the length of the safety lines are of set footage so that the passenger is prevented from contact with the ground or either wire during any part of the flight. As the flight terminates, the wires, rings and safety lines, performing together, provide the passenger with safe, elevated protection from ground impact as well as dampened deceleration giving an experience similar to the parachute opening phase associated with sport skydiving.

The objective of the disclosure is to provide the thrill of acceleration, free tethered flight and safe landings by pneumatically controlling the flight distance based on known physical laws of leverage, throw weight, gravity, and gas pressure applied to catapults.

BRIEF DESCRIPTION OF THE DRAWINGS

FIGURE ONE is a complete perspective view of the catapult.

FIGURE TWO is a front view of the catapult including a partial front view of the safety landing apparatus. The passenger is shown in ghost.

FIGURE THREE is a full perspective view of the safety landing apparatus in operation with a flying passenger in ghost. The catapult is shown in miniature (preventing the inclusion of numbered parts) so that its size in relation to the safety landing apparatus can be properly observed.

DETAILED DESCRIPTION OF THE INVENTION

Referring to FIG. One, the catapult is shown in the rest position ready for boarding by a rider. The seat (1) for holding a rider is locked onto the top side at one end of the catapults throwing arm (2). The throwing arm (2) is held in place and rotatably attached to the top end of two upright support beams (3*a*, 3*b*) positioned along the two sides of the throwing arm (2). As observable in FIG. Two the throwing arm (2) and the support beams (3*a*, 3*b*) are rotatibly connected by a round pin rod (7) which is mounted transversally thru the throwing arm (2) and the support beams (3*a*, 3*b*) allowing the throwing arm (2) to rotate on a defined axis. The bottom end of the upright support beams (3*a*, 3*b*) are solidly joined to an elongate base platform (4). Two ground wings (5, 6) are fastened at 90-degree angles, on the bottom side and opposite ends of the base platform (4) to afford pitch and yaw stability to the catapult while in operation. Best seen in FIG. One, the throwing arm (2) is mechanically forced upward by two thrust legs (8*a*, 8*b*) which are rotatibly linked at their top end to the throwing arm (2) in separated positions fore and aft of the pin rod (7). Both bottom ends of the thrust legs (8*a*, 8*b*) are rotatibly linked together with coupling means (9) located at the front rod end portion of the air cylinder (10). The back end portion of the air cylinder (10) is rotativly braced by first and second struts (11*a*, 11*b*) which are firmly attached to the top surface of the base platform (4).

An air tank (12) and an attached air gauge (12*a*) is observable in FIG. One the purpose of which is to supply a measured amount of gas to the air cylinder (10). In preparing the catapult for operation the air tank (12) is filled with a predetermined quantity of pressurized gas based upon and in relation to the measured weight of the passenger allowing the necessary repeatability of a defined flight path after the person is catapulted. First and second air hoses (13*a*, 13*b*) and a air release valve (13) supply and control the passage of air from the air tank (12) to the air cylinder (10). When the air release valve (13) is in the open position, pressurized air travels from the air tank (12) thru the first air hose (13*a*) to the air release valve (13) and thru the second air hose (13*b*) and into the air cylinder (10).

The air cylinder (10), upon receiving a throw-weight designated quantity of gas from the air tank (12), will rotate the thrust legs (8*a*, 8*b*) rearward toward the air cylinder (10) forcing the throwing arm (2) upward away from the base platform (4). In the present invention the thrust legs (8*a*, 8*b*) are of a preset length. Also the thrust legs (8*a*, 8*b*) are positioned at a preset distance at their top end adjacent to the pin rod (7) so that a full stroke of the air cylinder (10) will force the throwing arm (2) thru a start and stop cycle of, for example, 45 degrees and in conjunction with the appropriate gas pressure, provide a defined flight path for the rider that is repeatable.

Having both the gas pressure and the passengers flight path controllable allows safe deployment of the human catapult and the cooperating flight landing apparatus, which are shown in FIG. Three. The passenger is shown in ghost and the catapult is shown in reduced size to provide perspective in relation to the safety landing apparatus.

The flight landing apparatus provides first and second safety lines (14*a*, 14*b*) affixed at their ends near the respective right and left side of the passengers' shoulders (shown in ghost). The other end of the each safety line (14*a*, 14*b*) is attached to first and second annular rings (15*a*, 15*b*) that encircle first and second suspension wires (16*a*, 16*b*) for a slidable connection there between. When properly connected the first safety line (14*a*) will be connected to the first ring (15*a*) which will encircle the first suspension wire (16*a*). The second safety line (14*b*) will be connected to the second ring (15*b*) which will encircle the second suspension wire (16*b*). The first suspension wire (16*a*) is held elevated and taught by a first set of anchored, vertical posts (17*a*, 17*b*) stationed at both ends of the suspension wire (16*a*). A second set of anchored posts (18*a*, 18*b*) suspend the second suspension wire (16*b*). A left side wire-post arrangement (17*a*, 16*a*, 17*b*) and a right side wire-post arrangement (18*a*, 16*b*, 18*b*) are each positioned lengthwise along respective right and left sides of the passengers predetermined flight path. The rings (15*a*, 15*b*) slide along the wires (16*a*, 16*b*), being pulled by the passenger's safety lines (14*a*, 14*b*) as the riders flight progresses from beginning to end. The two posts (17*a*, 18*a*) positioned near the catapult are of lesser predetermined height than the posts (17*b*, 18*b*) positioned near the end of the flight path allowing the slope of the suspension wires (16*a*, a rate approximately equal to the maximum height achieved in the preset flight path affording the passenger tethered flight above the suspension wires (16*a*, 16*b*). The physical distance between the suspension wires (16*a*, 16*b*) and the length of the safety lines (14*a*, 14*b*) are of set footage so that the passenger is prevented from contact with the ground or either suspension wire (16*a*, 16*b*) during any part of the flight. As the flight terminates, the suspension wires (16*a*, 16*b*), rings (15*a*, 15*b*) safety lines 14*a*, 14*b*) and posts 17*a*, 17*b*, 18*a*, 18*b*), performing together, provide the passenger with safe, elevated protection from ground impact as well as dampened deceleration giving an experience similar to the parachute opening phase associated with sport skydiving but at much slower descending velocity.

I claim:

1. A combined human catapult and safety landing apparatus comprising:

a) an elongate throwing arm to guide a passengers flight;

b) a seat attached to said throwing arm locked onto the top of and at the distal end of the throwing arm;

c) a pair of support beams positioned at each side of said throwing arm to provide placement of the throwing arm above ground level;

d) a pin rod mounted transversally between the top end of said support beams and said throwing arm to allow rotational engagement there between;

e) a base platform securely fastened to the bottom end of said support beams disposed below and parallel to said throwing arm;

f) a pair of attached wings positioned one at each end and under said base platform to dampen pitch and yaw;

g) a pair of thrust legs rotationally mounted at their top end to said throwing arm positioned respectively ahead and behind said pin rod;

h) an pneumatic air cylinder having attached a front end coupling means and said coupling means having rotative engagement to the bottom ends of said thrust legs;

i) a pair of struts fastened securely to the top side of said base platform having rotational attachment to the back end of said pneumatic air cylinder;

j) an air tank for holding a predetermined quantity of gas;

k) a first air hose connected to said air tank;

l) an air valve connected to said first air hose;

m) a second air hose connected between said air valve and said air cylinder;

n) an air gauge connected to said air tank;

o) a first and second safety line wherein each of one end is provided for individual attachment to a passenger;

p) a first and second ring connected respectively to the opposite end of said first and second safety lines;

q) a first and second suspension line connected respectively by encirclement with said first and second rings for sliding engagement there between;

r) a first pair of spaced apart posts having said first suspension line linked there between and s) a second pair of spaced apart posts having said second suspension line linked there between.

* * * * *